US005450522A

United States Patent [19]

Hermansky et al.

[11] Patent Number: 5,450,522

[45] Date of Patent: Sep. 12, 1995

[54] AUDITORY MODEL FOR PARAMETRIZATION OF SPEECH

[75] Inventors: Hynek Hermansky, Denver, Colo.; Nelson H. Morgan; Philip D. Kohn, both of Oakland, Calif.

[73] Assignees: U S West Advanced Technologies, Inc., Boulder, Colo.; International Computer Science Institute, Berkeley, Calif.

[21] Appl. No.: 747,181

[22] Filed: Aug. 19, 1991

[51] Int. Cl.[6] ..... G10L 9/00

[52] U.S. Cl. ..... 395/2.2; 395/2.1

[58] Field of Search ..... 381/29–53; 395/2.1–2.39

[56] References Cited

U.S. PATENT DOCUMENTS

| | | | |
|---|---|---|---|
| 4,433,210 | 2/1984 | Ostrowski et al. | 381/53 |
| 4,542,524 | 9/1985 | Laine | 381/53 |
| 4,709,390 | 11/1987 | Atal et al. | 381/51 |
| 4,797,926 | 1/1989 | Bronson et al. | 381/36 |
| 4,805,218 | 2/1989 | Bamberg et al. | 381/43 |
| 4,820,059 | 4/1989 | Miller et al. | 381/43 |
| 4,885,790 | 12/1989 | McAulay et al. | 381/36 |
| 4,897,878 | 1/1990 | Boll et al. | 381/43 |
| 4,908,865 | 3/1990 | Doddington et al. | 381/43 |
| 4,932,061 | 6/1990 | Kroon et al. | 381/30 |
| 4,975,955 | 12/1990 | Taguchi | 381/36 |
| 4,975,956 | 12/1990 | Liu et al. | 381/36 |
| 5,136,531 | 8/1992 | McCaslin | 364/724.09 |

OTHER PUBLICATIONS

Rabiner and Schafer, *Digital Processing of Speech Signals*, (Prentice-Hall, Inc. 1978), pp. 116–119, 250–347, 432–435, Nov. 1979.

"Perceptual linear predictive (PLP) analysis of speech", by Hynek Hermansky, Apr. 1990. J. Acoust. Soc. Am. 87(4), pp. 1738–1752.

Furui, S. "Comparison of Speaker Recognition Methods Using Statistical Features and Dynamic Features", Dec. 1981, IEEE, pp. 342–350.

*Primary Examiner*—Allen R. MacDonald
*Assistant Examiner*—Michelle Doerrler
*Attorney, Agent, or Firm*—Brooks & Kushman

[57] ABSTRACT

A method and system are provided for alleviating the harmful effects of convolutional distortions of speech, such as the effect of a telecommunication channel, on the performance of an automatic speech recognizer (ASR). The technique is based on the filtering of time trajectories of an auditory-like spectrum derived from the Perceptual Linear Predictive (PLP) method of speech parameter estimation.

12 Claims, 7 Drawing Sheets

AUDITORY MODEL FOR PARAMETRIZATION OF SPEECH

Technical Field

The invention relates to speech processing and, in particular, to an auditory model for speech parameter estimation.

BACKGROUND ART

As is known, the first step for automatic speech recognition (ASR) is front-end processing, during which a set of parameters characterizing a speech segment is determined. Generally, the set of parameters should be discriminative, speaker-independent and environment-independent.

For the set to be discriminative, it should be sufficiently different for speech segments carrying different linguistic messages. A speaker-independent set should be similar for speech segments carrying the same linguistic message but spoken or uttered by different speakers, while an environment-independent set should be similar for the speech segments which carry the same linguistic message, produced in different environments, soft or loud, fast or slow, with or without emotions and processed by different communication channels.

U.S. Pat. No. 4,433,210, Ostrowski et al., discloses anintegrated circuit phoneme-based speech synthesizer. A vocal tract comprised of a fixed resonant filter and a plurality of tunable resonant filters is implemented utilizing a capacitive switching technique to achieve relatively low frequencies of speech without large valued componentry. The synthesizer also utilizes a digital transition circuit for transitioning values of the vocal tract from phoneme to phoneme. A glottal source circuit generates a glottal pulse signal capable of being spectrally shaped in any manner desired.

U.S. Pat. No. 4,542,524 Laine, discloses a model and filter circuit for modeling an acoustic sound channel, uses of the model and a speech synthesizer for applying the model. An electrical filter system is employed having a transfer function substantially consistent with an acoustic transfer function modelling the sound channel. The sound channel transfer function is approximated by mathematical decomposition into partial transfer functions, each having a simpler spectral structure and approximated by a realizable rational transfer function. Each rational transfer functions has a corresponding electronic filter, the filters being cascaded.

U.S. Pat. No. 4,709,390, Atal et al., discloses a speech coder for linear predictive coding (LPC). A speech pattern is divided in successive time frames. Spectral parameter and multipulse excitation signals are generated for each frame and voiced excitation signal intervals of the speech pattern are identified, one of which is selected. The excitation and spectral parameter signals for the remaining voiced intervals are replaced by the multipulse excitation signal and the spectral parameter signals of the selected interval, thereby substantially reducing the number of bits corresponding to the succession of voiced intervals.

U.S. Pat. No. 4,797,926, Bronson et al., discloses a speech analyzer and synthesizer system. The analyzer is utilized for encoding and transmitting, for each speech frame, the frame energy, speech parameters defining the vocal tract (LPC coefficients), a fundamental frequency and offsets representing the difference between individual harmonic frequencies and integer multiples of the fundamental frequency for subsequent speech synthesis. The synthesizer, responsive to the transmitted information, calculates the phases and amplitudes of the fundamental frequency and the harmonics and uses the calculated information to generate replicated speech. The invention further utilizes either multipulse or noise excitation modeling for the unvoiced portion of the speech.

U.S. Pat. No. 4,805,218, Bamberg et al., discloses a method for speech analysis and speech recognition which calculates one or more difference parameters for each of a sequence of acoustic frames. The difference parameters can be slope parameters, which are derived by finding the difference between the energy of a given spectral parameter of a given frame and the energy, in a nearby frame, of a spectral parameter associated with a different frequency band, or energy difference parameters, which are calculated as a function of the difference between a given spectral parameter in one frame and spectral parameter in a nearby frame representing the same frequency band. U.S. Pat. No. 4,885,790, McAulay et al., discloses a speech analysis/synthesis technique wherein a speech waveform is characterized by the amplitudes, frequencies and phases of component sine waves. Selected frames of samples from the waveform are analyzed to extract a set of frequency components, which are tracked from one frame to the next. Values of the components from one frame to the next are interpolated to obtain a parametric representation of the waveform, allowing a synthetic waveform to be constructed by generating a series of sine waves corresponding to the parametric representation.

U.S. Pat. No. 4,897,878, Boll et al., discloses a method and apparatus for noise suppression for speech recognition systems employing the principle of a least means square estimation implemented with conditional expected values. A series of optimal estimators are computed and employed, with their variances, to implement a noise immune metric, which enables the system to substitute a noisy distance with an expected value. The expected value is calculated according to combined speech and noise data which occurs in the bandpass filter domain.

U.S. Pat. No. 4,908,865, Doddington et al., discloses a speaker-independent speech recognition method and system. A plurality of reference frames of reference feature vectors representing reference words are stored. Spectral feature vectors are generated by a linear predictive coder for each frame of the input speech signals, the vectors then being transformed to a plurality of filter bank representations. The representations are then transformed to an identity matrix of transformed input feature vectors and feature vectors of adjacent frames are concatenated to form the feature vector of a framepair. For each reference frame pair, a transformer and a comparator compute the likelihood that each input feature vector for a framepair was produced by each reference frame.

U.S. Pat. No. 4,932,061, Kroon et al., discloses a multi-pulse excitation linear predictive speech coder comprising an LPC analyzer, a multi-phase excitation generator, means for forming an error signal representative of difference between an original speech signal and a synthetic speech signal, a filter for weighting the error signal and means responsive thereto for generating pulse parameters controlling the excitation generator, thereby minimizing a predetermined measure of the weighted error signal.

U.S. Pat. No. 4,975,955, Taguchi, discloses a speech signal coding and/or decoding system comprising an LPC analyzer for deriving input speech parameters which are then attenuated and fed to an LSP analyzer for deriving LSP parameters. The LSP parameters are then supplied to a pattern matching device which selects from a reference pattern memory the reference pattern which most closely resembles the input pattern from the LSP analyzer.

U.S. Pat. No. 4,975,956, Liu et al., discloses a low-bit-rate speech coder using LPC data reduction processing. The coder employs vector quantization of LPC parameters, interpolation and trellis coding for improved speech coding at low bit rates utilizing an LPC analysis module, an LSP conversion module and a vector quantization and interpolation module. The coder automatically identifies a speaker's accent and selects the corresponding vocabulary of codewords in order to more intelligibly encode and decode the speaker's speech.

Additionally, a new front-end processing technique for speech analysis, was discussed in Dr. Hynek Hermansky's article entitled "Perceptual Linear Predictive (PLP) Analysis of Speech," J Acoust. Soc. Am. 87(4), Apr., 1990, which is hereby incorporated by reference. In the PLP technique, an estimation of the auditory spectrum is derived utilizing three well-known concepts from the psychophysics of hearing: the critical-band spectral resolution, the equal-loudness curve and the intensity-loudness power law. The auditory spectrum is then approximated by an autoregressive all-pole model, resulting in a computationally efficient analysis that yields a low-dimensional representation of speech, properties useful in speaker-independent automatic speech recognition. A flow chart detailing the PLP technique is shown in FIG. 1.

Most current ASR front-ends are based on robust and reliable estimation of instantaneous speech parameters. Typically, the front-ends are discriminative, but are not speaker- or environment-independent. While training of the ASR system (i.e. exposure to a large number of speakers and environmental conditions) can compensate for the failure, such training is expensive and seldom exhaustive. The PLP front-end is relatively speaker independent, as it allows for the effective suppression of the speaker-dependent information through the selection of the particular model order.

Most speech parameter estimation techniques, including the PLP technique, however, are sensitive to environmental conditions since they utilize absolute spectral values that are vulnerable to deformation by steady-state non-speech factors, such as channel conditions and the like.

SUMMARY OF INVENTION

It is therefore an object of the present invention to provide a method for the parametrization of speech that is more robust to steady-state spectral distortions.

In carrying out the above object and other objects of the present invention in a speech processing system in a speech processing system including means for computing a plurality of temporal speech parameters including short-term parameters having time trajectories, a method is provided for alleviating the harmful effects of distortions of speech. The method comprises filtering data representing time trajectories of the short-term parameters of speech so as to minimize distortions due to steady-state factors in speech.

A system is also provided for carrying out the above method.

The above objects and other objects and features of the invention will be readily appreciated by one of ordinary skill in the art from the following detailed description of the best mode for carrying out the invention when taken in connection with the following drawings.

Best Mode For Carrying Out The Invention

Generally, the auditory model of the present invention is based on the model of human vision in which the spatial pattern on the retina is differentiated with consequent re-integration. Such a model accounts for the relative perception of shades and colors. The auditory model of the present invention applies similar logic and assumes that relative values of components of the auditory-like spectrum of speech, rather than absolute values of the components, carry the information in speech.

Figure 1:
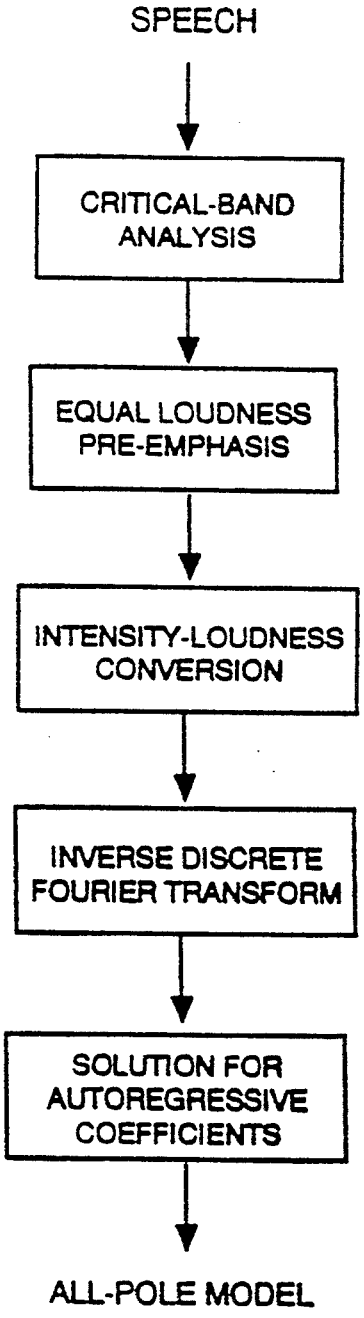
Fig. 1 PRIOR ART
FIG. 1 is a flow chart illustrating the Perceptual Linear Predictive PLP) technique for speech parameter estimation.
Figure 2:
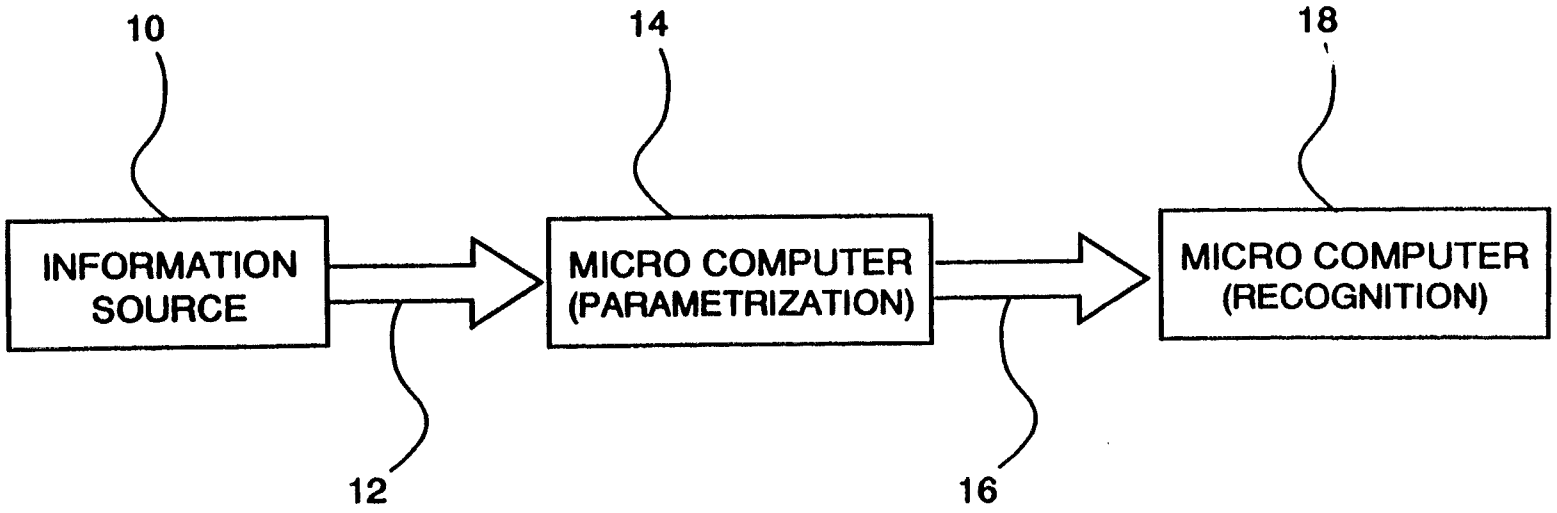
FIG. 2 is a block diagram of a system for implementing the RelAtive SpecTrAl (RASTA) PLP technique of the present invention for speech parameter estimation.
Figure 3:
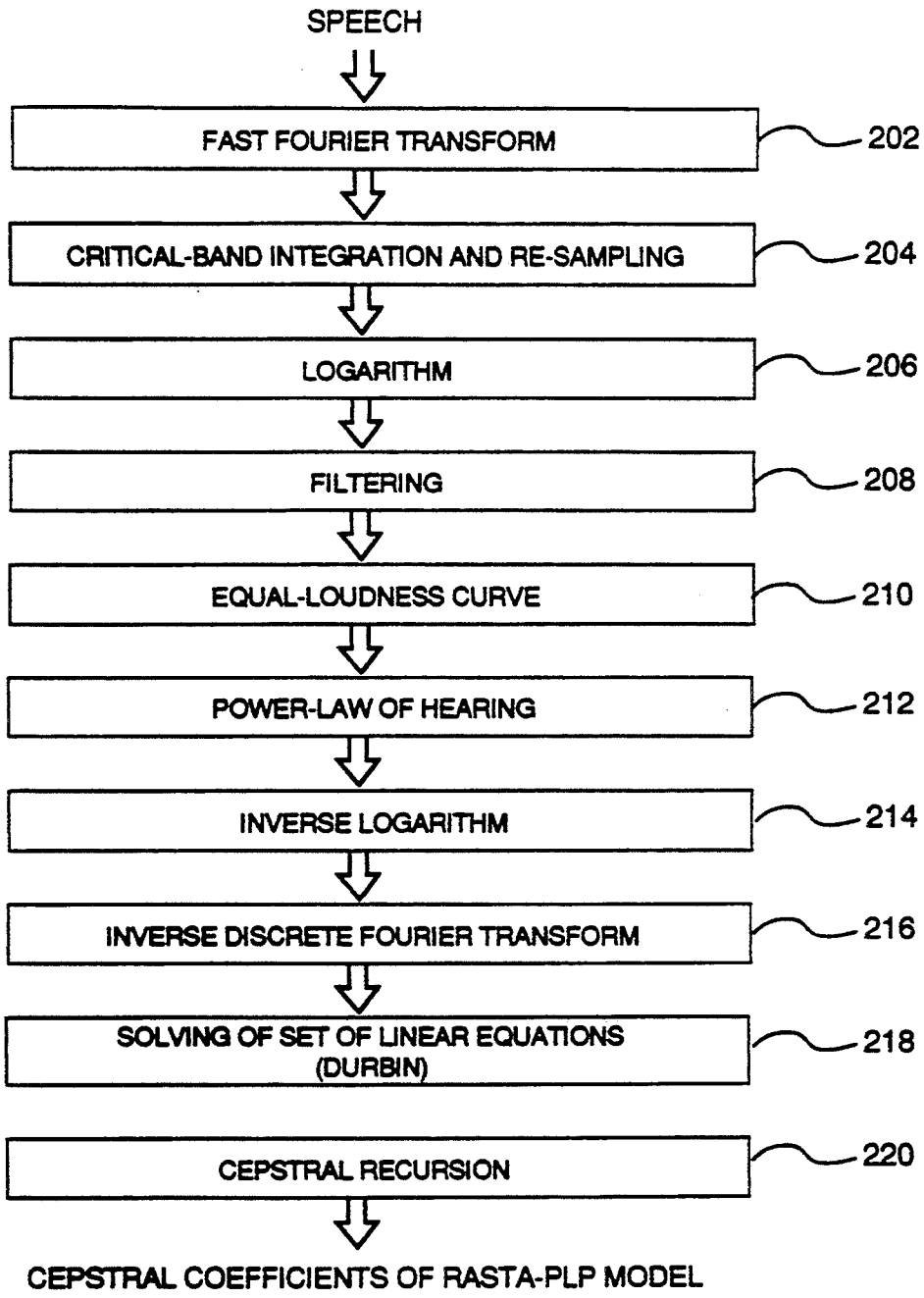
FIG. 3 is s a flow chart illustrating the steps of the RASTA-PLP technique.

Referring now to FIG. 2 and FIG. 3, a block diagram of a system for implementing the RelAtive SpecTrAl Perceptual Linear Predictive (RASTA PLP) technique for the parametric representation of speech and a flow chart illustrating the methodology are shown. The RASTA PLP technique is discussed in the paper entitled "Compensation For The Effect Of The Communication Channel In Auditory-Like Analysis 0f Speech (RASTA-PLP)" by H. Hermansky, N. Morgan, A. Bayya and P. Kohn, to be presented at the Eurospeech '91, the 2nd European Conference On Speech Communication and Technology, held in Genova, Italy on 24–26 Sep. of 1991, which is hereby incorporated by reference.

In the preferred embodiment, speech signals from an information source 10, such as a human speaker, are transmitted over a plurality of communication channels 12, such as telephone lines, to a microcomputer 14. The microcomputer 14 segments the speech into a plurality of analysis frames and performs front-end processing according to the RASTA PLP methodology.

Figure 4:
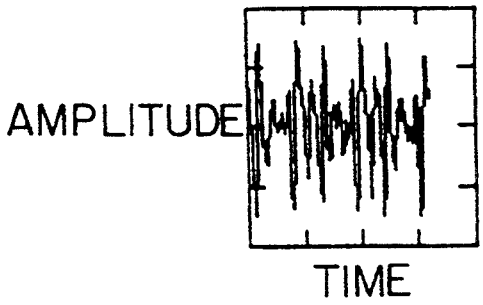
FIG. 4 is a graphical representation of a speech segment waveform prior to processing according to the RASTA PLP technique.

A sample speech segment waveform is shown in FIG. 4. After processing, the data is transmitted over a bus 16 to another microcomputer (not specifically illustrated) which carries out the recognition. It should be noted that a number of well known speech recognition techniques such as dynamic time warping template matching, hidden markov modeling, neural net based pattern matching, or feature-based recognition, can be employed with the RASTA PLP methodology.

A PLP spectral analysis is performed at step 202 by first weighting each speech segment by a Hamming window. As is known, a Hamming window is a finite duration window and can be represented as follows:

$$W(n) - 0.54 + 0.46 \cos[2\pi n/(i-1)]$$

where N, the length of the window, is typically about 20 mS.

Next, the weighted speech segment is transformed into the frequency domain by a discrete Fourier transform (DFT). The real and imaginary components of the resulting short-term speech spectrum are then squared and added together, thereby resulting in the short-term power spectrum $P(\omega)$ and completing the spectral analysis. The power spectrum $P(\omega)$ can represented as follows:

$$P(\omega) - Re[S(\omega))]^2 + Im[S(\omega))]^2.$$

Figure 5:
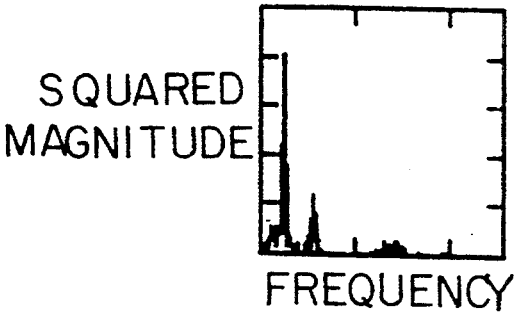
FIG. 5 is a graphical representation of the speech segment power spectrum resulting from applying a fast Fourier transform to the speech segment waveform shown in FIG. 4.

A fast Fourier transform (FFT) is preferably utilized, resulting in a transformed speech segment waveform as shown in FIG. 5. Typically, for a 10 kHz sampling frequency, a 256-point FFT is needed for transforming the 200 speech samples from the 20 mS window, padded by 56 zero-valued samples.

Figure 6:
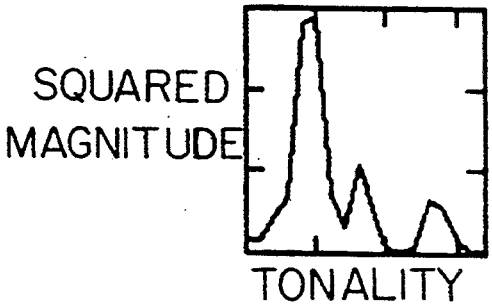
FIG. 6 is a graphical representation of the speech segment spectrum resulting from performing a critical-band integration and re-sampling on the speech segment spectrum of FIG. 5.

Critical-band integration and re-sampling, performed at step 204, results in the speech segment spectrum shown in FIG. 6. This step involves first warping the short-term power spectrum $P(\omega)$ along its frequency axis $\omega$ into the Bark frequency $\Omega$ as follows:

$$\Omega(\omega) = 6\ln\left\{\frac{\omega}{1200\pi} + \left[\left(\frac{\omega}{1200\pi}\right)^2 + 1\right]^{0.5}\right\}$$

wherein $\omega$ is the angular frequency in rad/S, resulting in a Bark-Hz transformation. The warped power spectrum is then convolved with the power spectrum of the simulated critical-band masking curve $\Psi(\omega)$.

It should be appreciated that this step is similar to spectral processing in mel cepstral analysis, except for the particular shape of the critical-band curve. In the PLP technique, the critical-band curve is defined as follows:

$$\Psi(\Omega) = \begin{cases} 0 & \text{for } \Omega < -1.3, \\ 10^{2.5(\Omega+0.5)} & \text{for } -1.3 < \Omega < -0.5, \\ 1 & \text{for } -0.5 < \Omega < 0.5, \\ 10^{-1.0(\Omega-0.5)} & \text{for } 0.5 < \Omega < 2.5, \\ 0 & \text{for } \Omega > 2.5. \end{cases}$$

P This piece-wise shape for the simulated critical-band masking curve is an approximation to an asymmetric masking curve. Although it is a rather crude approximation of what is known about the shape of auditory filters, it exploits the proposal that the shape of auditory filters is approximately constant on the Bark scale. The filter skirts are generally truncated at −40 dB.

The discrete convolution of $\Psi$ ($\Omega$) with (the even symmetric and periodic function) $P(\omega)$ yields samples of the critical-band power spectrum $$\theta(\Omega_i) = \sum_{\Omega=-1.3}^{2.5} P(\Omega - \Omega_i)\Psi(\Omega).$$

Thus, the convolution with the relatively broad critical-band masking curves $\omega(\Omega)$ significantly reduces the spectral resolution of $\theta(\Omega)$ in comparison with the original $P(\omega)$, allowing for the down-sampling of $\theta(\Omega)$.

Preferably, $\theta(\omega)$ is sampled in approximately 1-Bark intervals. The exact value of the sampling interval is chosen so that an integral number of spectral samples covers the whole analysis band. Typically, 18 spectral samples of $\theta[\Omega(\omega)]$ are used to cover the 0–16.9-Bark (0–5 kHz) analysis bandwidth in 0.994-Bark steps.

Figure 7:
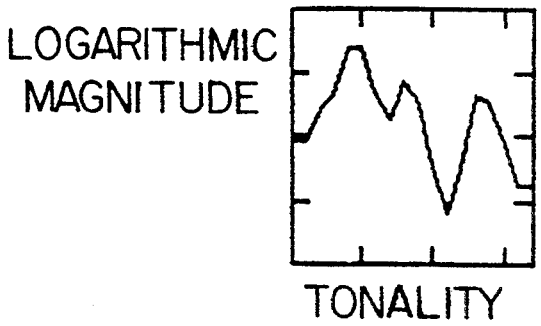
FIG. 7 is a graphical representation of the speech segment spectrum resulting from performing a logarithmic operation on the speech segment spectrum of FIG. 6.
Figure 8:
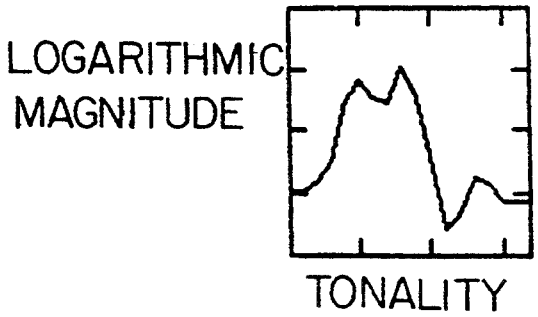
FIG. 8 is a graphical representation of the speech segment spectrum resulting from performing bandpass filtering on each channel of the speech segment spectrum of FIG. 7.

At step 206, a logarithmic operation is performed on the computed critical-band spectrum, resulting in the speech segment waveform shown in FIG. 7. Any convolutive constants, such as the characteristics of the telephone channel or of the particular CPE telephone set used, should show as an additive constant in the logarithm.

At step 208, the temporal filtering of the log critical-band spectrum is performed. In the preferred embodiment, a bandpass filtering of each frequency channel is performed through an IIR filter. The highpass portion of the equivalent bandpass filter alleviates the effect of the convolutional noise introduced in the channel and the low-pass filtering helps in smoothing out some of the fast frame-to-frame spectral changes due to analysis artifacts. The transfer function is preferably represented as follows:

$$H(z) = (.1)\frac{2 + z^{-1} - z^{-3} - 2z^{-4}}{1 - 0.98\, z^{-1}(z^{-4})}$$

The low cut-off frequency of the filter is 0.26 Hz and determines the fastest spectral change of the log spectrum which is ignored in the output, while the high cut-off frequency (i.e. 12.8 Hz ) determines the fastest spectral change which is preserved in the output parameters. The filter slope declines 6 dB/octave from 12.8 Hz with sharp zeros at 28.9 Hz and at c (50 Hz).

As is known, the result of any IIR filtering is generally dependent on the starting point of the analysis. In the RASTA PLP technique, the analysis is started well in the silent part preceding speech. It should be noted that the same filter need not be used for all frequency channels and that the filter employed does not have to be a bandpass filter or even a linear filter.

Figure 9:
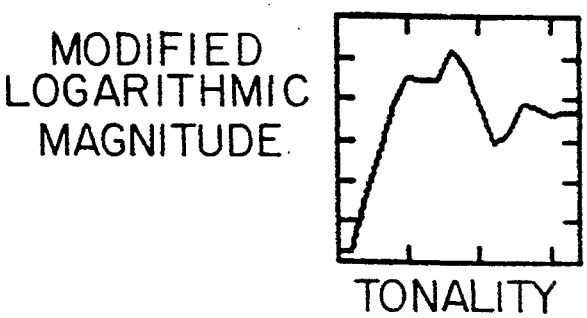
FIG. 9 is a graphical representation of the speech segment spectrum resulting from application of the equal-loudness curve to the speech segment spectrum of FIG. 8.

At step 210, the sampled $\theta[\Omega(\omega)]$ , described in greater detail above, is pre-emphasized by the simulated fixed equal-loudness curve, as in the conventional PLP technique, resulting in the speech segment spectrum shown in FIG. 9. The equal-loudness curve can be represented as follows:

$$\Xi[\Omega(\omega)]-E(\omega)\theta[\Omega(\omega)]$$

It should be noted that the function $E(\omega)$ is an engineering approximation to the nonequal sensitivity of human hearing at different frequencies and simulates the sensitivity of hearing at about the 40- dB level. The approximation is preferably defined as follows:

$$E(\omega) = \frac{(\omega^2 + 56.8 \times 10^6)\omega^4}{\omega^2 + 6.3 \times 10^6)^2 (\omega^2 + 0.38 \times 10^9)}.$$

This approximation represents a transfer function of a filter having asymptotes of 12 dB/octave between 0 Hz and 400 Hz, 0 dB/octave between 400 Hz and 1200 Hz, 6 dB/octave between 1200 Hz and 3100 Hz and 0 dB/octave between 3100 Hz and the Nyquist frequency. For moderate sound levels, this approximation performs reasonably well up to 5 kHz.

It should be noted that for applications requiring a higher Nyquist frequency, an additional term representing a rather steep (e.g. −18 db/octave) decrease of the sensitivity of hearing for frequencies higher than 5 kHz might be found useful.

The corresponding approximation could then be represented as follows:

$$E(\omega) = \frac{(\omega^2 + 56.8 \times 10^6)\omega^4}{(\omega^2 + 6.3 \times 10^6)^2 (\omega^2 + 0.38 \times 10^9) (\omega^6 + 9.58 \times 10^2}$$

Finally, the values of the first (0 Bark) and the last (Nyquist frequency) samples, which are not well defined, are made equal to the values of their nearest neighbors, so that $\Xi[\Omega(\omega)]$ begins and ends with two equal-valued samples.

Figure 10:
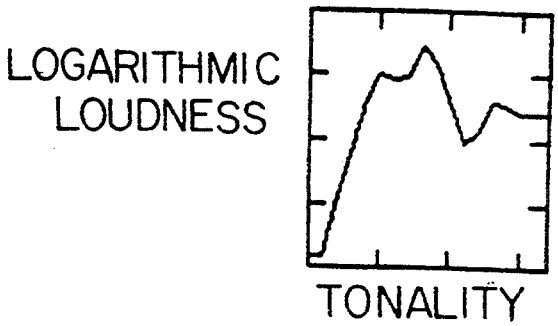
FIG. 10 is a graphical representation of the speech segment spectrum resulting from application of the power law of hearing to the speech segment spectrum of FIG. 9.

After adding the equal-loudness curve, an engineering approximation to the power law of hearing is performed at step 212 on the critical-band spectrum, resulting in the speech segment spectrum shown in FIG. 10. This approximation involves a cubic-root amplitude compression of the spectrum as follows:

$$\Phi(\Omega)-\Xi(\Omega)^{0.33}$$

It should be appreciated that this approximation simulates the nonlinear relation between the intensity of sound and its perceived loudness. Together with the psychophysical equal-loudness preemphasis described in greater detail above, this operation also reduces the spectral-amplitude variation of the critical-band spectrum so that an all-pole modeling, as discussed in greater detail below, can be done by a relatively low model order.

Figure 11:
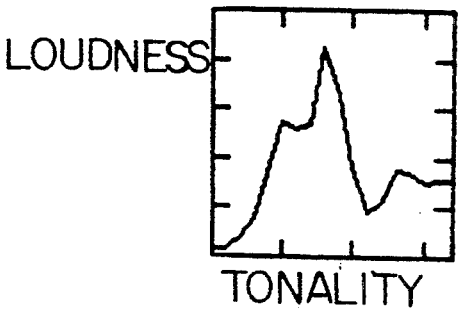
FIG. 11 is a graphical representation of the speech segment spectrum resulting from performing an inverse logarithmic operation on the speech segment spectrum shown in FIG. 10.

At step 214, an inverse logarithmic operation (i.e. exponential function) is performed on the compressed log critical-band spectrum. Taking the inverse log of this relative log spectrum yields a relative auditory spectrum, shown in FIG. 11.

A minimum-phase all-pole model of the relative auditory spectrum $\Phi(\Omega)$ is computed at steps 216 through 220 according to the PLP technique utilizing the autocorrelation method of all-pole spectral modeling. At step 216, an inverse discrete Fourier transform (IDFT) is applied to $\Phi(\Omega)$ to yield the autocorrelation function dual to $\Phi(\Omega)$. Typically, a thirty-four (34) point IDFT is used. It should be noted that the applying an IDFT is a better approach than applying an IFFT, since only a few autocorrelation values are required.

The basic approach to autoregressive modeling of speech known as linear predictive analysis is to determine a set of coefficients that will minimize the mean-squared prediction error over a short segment of the speech waveform. One such approach is known as the autocorrelation method of linear prediction.

Figure 12:
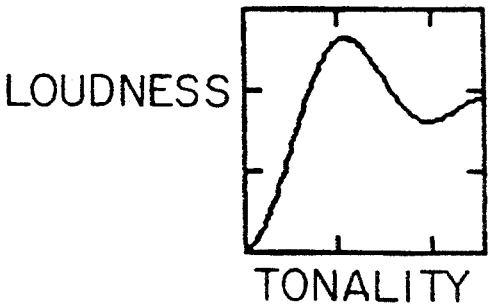
FIG. 12 is a graphical representation of the speech segment spectrum resulting from performing an inverse discrete Fourier transform on the speech segment spectrum shown in FIG. 11.

It should be appreciated that this approach provides a set of linear equations relating to the autocorrelation coefficients of the signal and the prediction coefficients of the autoregressive model. Such set of equations can be efficiently solved to yield the predictor parameters. Since the inverse Fourier transform of the nonnegative spectrum-like function such as the relative auditory spectrum shown in FIG. 11, can be interpreted as the autocorrelation function, the appropriate autoregressive model of such spectrum can be found. In the preferred embodiment, these equations are solved at step 218 utilizing Durbin's well known recursive procedure, the efficient procedure for solving the specific linear equations of the autoregressive process. The spectrum of the resulting all-pole model is shown in FIG. 12.

The group-delay distortion measure is used in the PLP technique instead of the conventional cepstral distortion measure, since the group-delay measure is more sensitive to the actual value of the spectral peak width. The group-delay measure (i.e. frequency-weighted measure, index-weighted cepstral measure, root-power-sum measure) is implemented by weighting cepstral coefficients of the all-pole PLP model spectrum in the Euclidean distance by a triangular lifter.

At step 220, the cepstral coefficients are computed recursively from the autoregressive coefficients of the all-pole model. The triangular liftering (i.e. the index-weighting of cepstral coefficients) is equivalent to computing a frequency derivative of the cepstrally smoothed phase spectrum. Consequently, the spectral peaks of the model are enhanced and its spectral slope is suppressed.

For a minimum-phase model, computing the Euclidean distance between index-weighted cepstral coefficients of two models is equivalent to evaluating the Euclidean distance between the frequency derivative of the cepstrally smoothed power spectra of the models. Thus, the group-delay distortion measure is closely related to a known spectral slope measure for evaluating critical-band spectra and is given by the equation $$d_{GD} = \sum_{i=1}^{p} i^2(c_{iR} - c_{iT})^2$$

where CiR and CiT are the cepstral coefficients of the reference and test all-pole models, respectively, and P is the number of cepstral coefficients in the cepstral approximation of the all-pole model spectra.

It should be noted that the index-weighting of the cepstral coefficients which was found useful in well known recognition techniques utilizing Euclidean distance such as is the dynamic time warping template matching is less important in some another well known speech recognition techniques such as the neural net based recognition which inherently normalize all input parameters.

The choice of the model order specifies the amount of detail in the auditory spectrum that is to be preserved in the spectrum of the PLP model. Generally, with increasing model order, the spectrum of the allpole model asymptotically approaches the auditory spectrum $\Phi(\Omega)$. Thus, for the auto-regressive modeling to have any effect at all, the choice of the model order for a given application is critical.

A number of experiments with telephone-bandwidth speech have indicated that PLP recognition accuracy peaks at a $5^{th}$ order of the autoregressive model and is consistently higher than the accuracy of other conventional front-end modules, such as a linear predictive (LP) module. Because of these results, a $5^{th}$ order all-pole model is preferably utilized for telephone applications. A $5^{th}$ order PLP model also allows for a substantially more effective suppression of speaker-dependent information than conventional modules and exhibits properties of speaker-normalization of spectral differences.

It should be noted that the choice of the optimal model order can be dependent on the particular application. Typically, higher the sampling rate of the signal and larger the set of training speech samples, higher the optimal model order.

It should be appreciated that most conventional approaches to suppressing the effect of noise and/or linear spectral distortions typically require an explicit noise or channel spectral estimation phase. The RASTA PLP method, however, efficiently computes estimates online, which is beneficial in applications such as telecommunications, where channel conditions are generally not known a priori and it is generally not possible to provide an explicit normalization phase.

Figure 13:
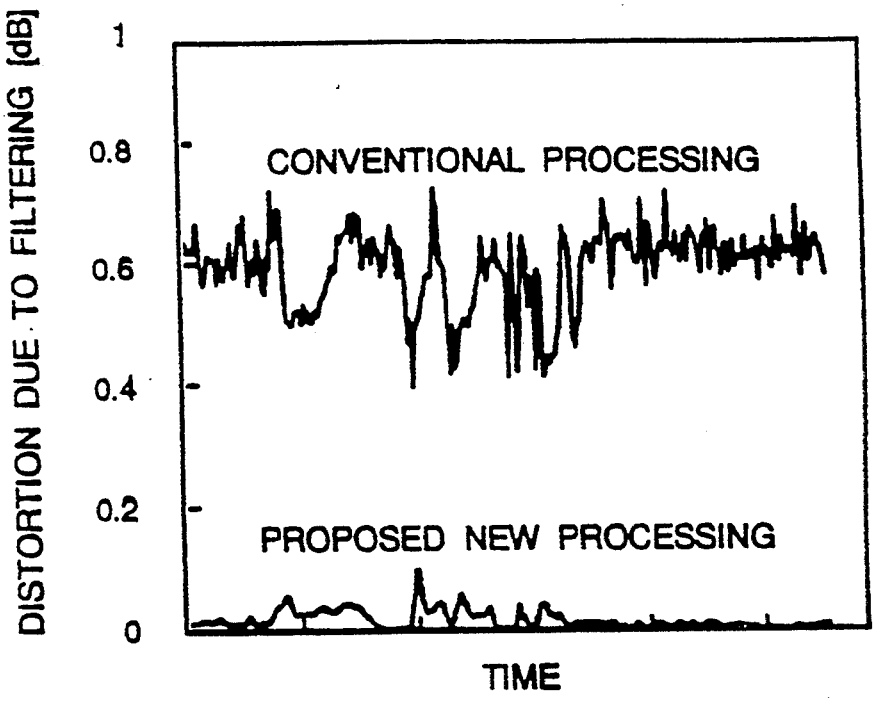
FIG. 13 is a graphical representation of the efficiency of the RASTA PLP technique compared to the PLP technique.

Turning now to FIG. 13, there is shown a graphical representation of the efficiency of the RASTA methodology. Test speech data were processed by a fixed moderate (i.e. 6 dB/octave) high-pass filter to simulate changing communication channel conditions and determine the effect on parameters derived by the conventional spectrum-based auditory-like PLP processing and the temporal derivative-based (RASTA PLP) processing.

FIG. 13 shows the spectral distance between autoregressive models estimated from the original speech utterance and the models estimated from the same utterance filtered through the high-pass linear filter with approximately 6 dB/oct spectral slope (signal differentiation). The conventional PLP technique yields large distortions, indicating its sensitivity to linear distortions. Thus, the RASTA-PLP yields and order of magnitude smaller distortions, indicating its robustness in presence of the linearly distorting convolutional noise.

It should be noted that the RASTA PLP methodology is conducted in the log spectral domain, due to concerns with the convolutional noise in the telephone channel. Of course, similar approaches could be utilized in the magnitude or power spectral domains for additive noise reduction when care is taken to ensure positivity of the enhanced power spectrum, as is also the case for traditional spectral subtraction techniques.

It is to be appreciated that in addition to the capabilities discussed above, the RASTA PLP processing also has the. ability to apply signal modifiers to the spectral temporal derivative domain. For example, a threshold imposed on small temporal derivatives could provide a further non-linear smoothing of the spectral estimates and non-linear amplitude modifications could enhance or suppress speech transitions.

It is understood, of course, that while the form of the invention herein shown and described constitutes the preferred embodiment of the invention, it is not intended to illustrate all possible forms thereof. It will also be understood that the words used are words of description rather than limitation and that various changes may be made without departing from the spirit and scope of the invention as disclosed.

What is claimed is:

1. In a speech processing system including means for computing a plurality of temporal speech parameters including short-term parameters having time trajectories, a method for alleviating the harmful effects of distortions of speech, the method comprising:

filtering data representing time trajectories of the short-term parameters of speech so as to minimize distortions due to steady-state factors in speech.

2. The method as claimed in claim 1 wherein the short-term parameters of speech are spectral parameters.

3. The method as claimed in claim 2 wherein the step of filtering includes the step of bandpass filtering to simultaneously smooth the data and remove the influence of slow variations in the spectral parameters.

4. The method as claimed in claim 3 wherein the spectral parameters are parameters of an auditory-like spectrum.

5. The method as claimed in claim 4 further comprising the steps of taking the logarithm of the auditory-like spectrum to obtain a spectrum-like pattern and taking the inverse logarithm of the spectrum-like pattern after the step of band-pass filtering.

6. The method as claimed in claim 4 further comprising the step of approximating the band-pass filtered auditory-like spectrum by a spectrum of an autoregressive model using an autocorrelation method of linear predictive analysis.

7. A speech processing system including means for computing a plurality of temporal speech parameters. including short-term parameters having time trajectories, the system being useful for alleviating the harmful effects of steady-state distortions of speech, the system further comprising:

means for filtering the time trajectories of the short-term parameters of speech to obtain a temporal pattern in which distortions due to steady-state factors in speech are minimized.

8. The system as claimed in claim 7 wherein the short-term parameters are spectral parameters.

9. The system as claimed in claim 8 wherein the spectral parameters are parameters of an auditory-like spectrum.

10. The system as claimed in claim 9 further comprising means for taking the logarithm of the auditory-like spectrum to obtain a spectrum-like pattern and means for taking the inverse logarithm of the spectrum-like pattern.

11. The system as claimed in claim 9 further comprising means for approximating the band-pass filtered auditory-like spectrum by a spectrum of an autoregressive model using an autocorrelation method of linear predictive analysis.

12. The system of claimed in claim 7 wherein the means for filtering is accomplished by a bandpass filter.

* * * * *